US007690755B2

(12) United States Patent
Ouchi

(10) Patent No.: US 7,690,755 B2
(45) Date of Patent: Apr. 6, 2010

(54) IMAGE-FORMING APPARATUS HAVING PURGE/WIPING MECHANISM

(75) Inventor: Tetsuya Ouchi, Nagoya (JP)

(73) Assignee: Brother Kogyo Kabushiki Kaisha, Nagoya, Aichi-ken (JP)

( * ) Notice: Subject to any disclaimer, the term of this patent is extended or adjusted under 35 U.S.C. 154(b) by 672 days.

(21) Appl. No.: 11/567,872

(22) Filed: Dec. 7, 2006

(65) Prior Publication Data

US 2007/0132802 A1 Jun. 14, 2007

(30) Foreign Application Priority Data

Dec. 8, 2005 (JP) ..... 2005-355449

(51) Int. Cl.
*B41J 29/393* (2006.01)
*B41J 2/165* (2006.01)

(52) U.S. Cl. ..... 347/23; 347/19; 347/29; 347/30; 347/33

(58) Field of Classification Search ..... 347/23, 347/19, 24, 29, 30, 32, 33
See application file for complete search history.

(56) References Cited

U.S. PATENT DOCUMENTS 6,386,677 B1 5/2002 Imai et al.
6,494,560 B1 * 12/2002 Seshimo et al. ..... 347/23

FOREIGN PATENT DOCUMENTS

EP 0799701 A1 10/1997
JP H10-006528 A 1/1998
JP H11-078068 A 3/1999

* cited by examiner

*Primary Examiner*—Shih-wen Hsieh
(74) *Attorney, Agent, or Firm*—Baker Botts, LLP

(57) ABSTRACT

An image-forming apparatus having an inkjet type printer is configured to prevent ink from being wastefully consumed through a purge processing. Before next purge processing is executed, test printing is carried out. The user looks at the result of the test printing and inputs instruction indicating whether or not the next purge processing is to be executed. If the inputted instruction indicates that immediate purge processing is unnecessary, execution of the purge processing is prolonged. In this manner, a purge processing is not automatically executed but executed only when the test printing indicates that an ejection condition of ink is no good.

16 Claims, 8 Drawing Sheets

(PROCESSING OF MULTI-FUNCTION PERIPHERAL APPARATUS)

IMAGE-FORMING APPARATUS HAVING PURGE/WIPING MECHANISM

CROSS REFERENCE TO RELATED APPLICATIONS

This application claims priority from Japanese Patent Application No. 2005-355449 filed Dec. 8, 2006. The entire content of the priority application is incorporated herein by reference.

TECHNICAL FIELD

The disclosure relates to an image-forming apparatus, and more particularly to an image-forming apparatus having an inkjet type printing section, such as a multi-function device having a copying function, a scanning function, and a facsimile transmission/reception function.

BACKGROUND

Conventionally, there are commercially available image-forming apparatuses having an inkjet type printing section. The printing section includes a print head formed of an inkjet ejection port from which ink is ejected. This printing section sometimes suffers an inferior state of inkjet ejection such as air bubbles generated inside the print head during use or ink deposited on the surface of the ink ejection port. Further, in case of leaving the print head unused for a long period of time, ink clogging may take place on the ink ejection port, leading to faulty ejection. Since the printing quality degrades when a printing operation is carried out in the state of faulty ejection, purge processing is conducted in such a case to restore a proper ejection condition.

The purge processing is, for example, a treatment to suck in ink inside the print head by generating a negative pressure by means of a pump after placing a suction cap on the print head for sealing. By executing such purge processing, the ink ejection state can be recovered.

Japanese Patent Application Publication Nos. HEI-11-78068 and Hei-10-6528 disclose forcibly executing the purge processing at a preset time interval to maintain stable printing quality. However, when the purge processing is executed forcibly at the preset time interval, depending on installation environment such as temperature and humidity at an installation location where the image-forming apparatus is set up, there are cases where the purge processing is not necessarily required. Further, evaluation of the printing quality varies with the user, and this may present a dubious case leading to question if there was really a need of the purge processing.

In this manner, when the purge processing is carried out forcibly at the preset time interval, there are cases where the purge processing is not necessarily required. In such cases, there is a problem of ink being wasted.

SUMMARY

The present invention has been made to solve the above-mentioned problems. Accordingly, it is an object of the present invention to provide an image-forming apparatus which can meet user's demand for printing quality while being able to prevent wasteful consumption of ink.

In order to achieve the above and other objects, there is provided, in accordance with one aspect of the invention, an image-forming apparatus that includes a print head, a recovery mechanism, a time measuring unit, a testing unit, an input unit, and a control unit. The print head has an ink ejection port from which ink is ejected. The recovery mechanism executes recovery operations for recovering an ejection condition of ink ejected from the ink ejection port of the print head. The time measuring unit measures a preset period of time from a time when a recovery operation is executed by the recovery mechanism until a scheduled time when a subsequent recovery operation is to be executed. The testing unit is provided for instructing the print head to print a predetermined test image on a print medium after expiration of the preset period of time and before execution of the subsequent recovery operation. The input unit is configured to accept a user's evaluation with respect to the predetermined test image printed by the print head. The control unit instructs the recovery mechanism to extend execution of the subsequent recovery operation when the user's evaluation indicates that the predetermined test image printed by the print head is satisfactory.

Hence, a redundant recovery operation is not forcibly or automatically executed so that ink is prevented from being wastefully consumed.

It is desirable that the control unit instruct the recovery mechanism to execute the subsequent recovery operation when the user's evaluation indicates that the predetermined test image printed by the print head is unsatisfactory.

It is further desirable that the control unit further instructs the recovery mechanism to extend execution of the subsequent recovery operation when the input unit fails to receive the user's evaluation with respect to the predetermined test image printed by the print head.

In accordance with another aspect of the invention, there is provided an image-forming apparatus that includes a print head, a recovery mechanism, a time measuring unit, a testing unit, an input unit, and a control unit as described above. The print head, recovery mechanism, time measuring unit, testing unit, and input unit are the same as those described above. However, in this case, the control unit is configured to determine, based on the user's evaluation inputted to the input unit, whether or not the subsequent recovery operation is to be executed immediately after expiration of the preset period of time.

It is desirable that the control unit be further configured to determine non-execution of the subsequent recovery operation immediately after expiration of the preset period of time when the input unit fails to receive the user's evaluation with respect to the predetermined test image printed by the print head.

BRIEF DESCRIPTION OF THE DRAWINGS

Illustrative aspects in accordance with the invention will be described in detail with reference to the following figures wherein:

FIG. 5A is an explanatory diagram showing a printing quality check sheet printed during the regular purge processing;

DETAILED DESCRIPTION

Figure 1:
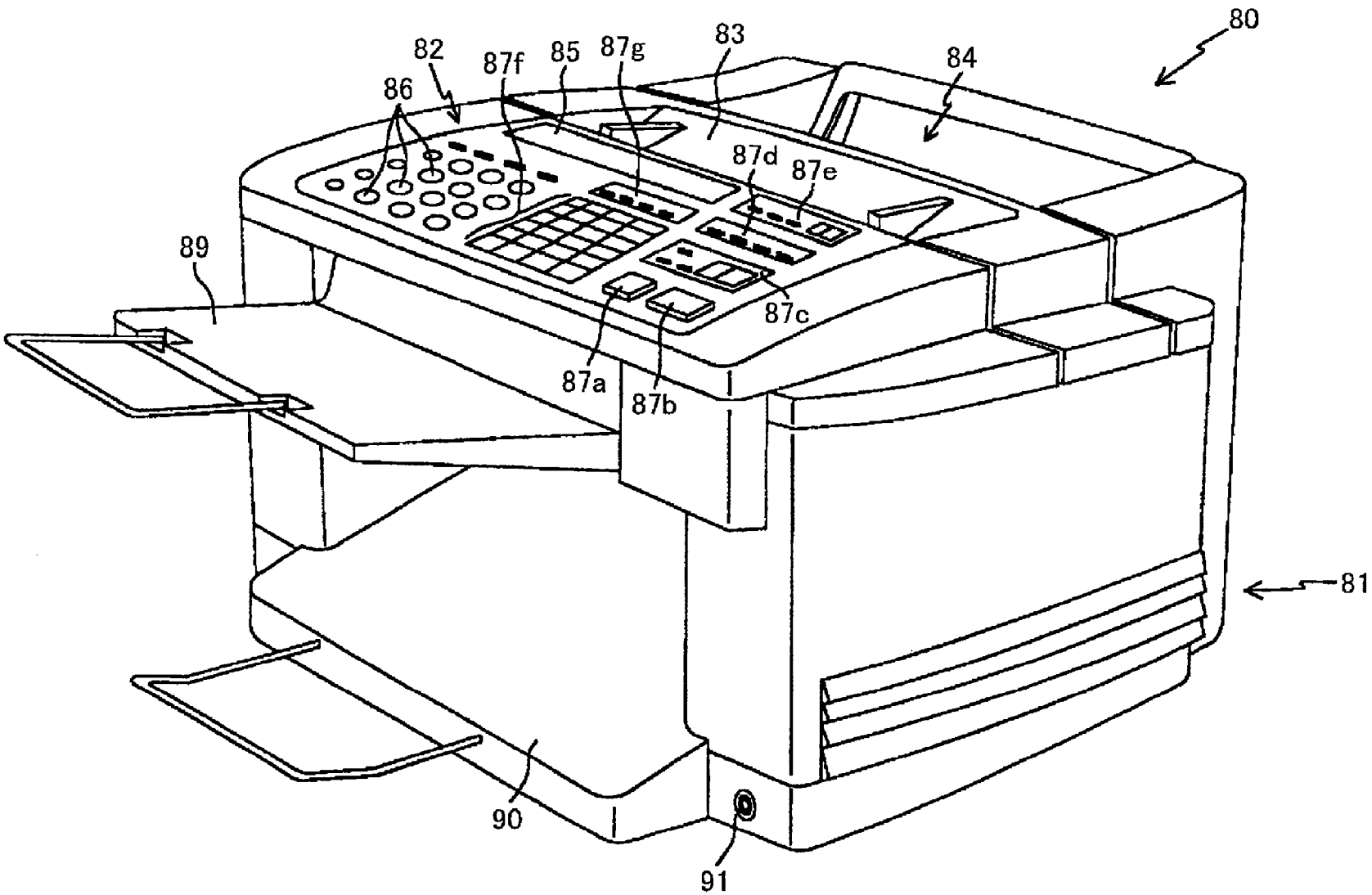
FIG. 1 is a perspective view showing a multi-function peripheral apparatus in accordance with one aspect of the invention.

Some aspects of the invention will be described while referring to the accompanying drawings wherein like parts and components are designated by the same reference numerals to avoid duplicating description.

FIG. 1 is a perspective view showing a multi-function peripheral apparatus 80 as an example of an image-forming apparatus. The multi-function peripheral apparatus 80 can execute various functions including facsimile transmission/reception function, copying function, scanning function, video-printing function, and printing function. To carry out printing in connection with execution of these functions, the apparatus is provided with a printer 61 of an inkjet type (see FIG. 2) capable of full color printing.

As shown in FIG. 1, the multi-function peripheral apparatus 80 has a body 81 formed in a substantially box shape. On the upper surface of the body thereof, there are mounted an operating panel 82 with various buttons arranged, a manuscript placement table 83, and a paper feeder 84 with paper cassettes (not shown) inserted, the paper cassettes in which print media of various sizes are stacked and stored.

On an upper part of the operating panel 82, there is arranged a liquid crystal display (LCD) 85 which indicates various messages such as a telephone or facsimile number when executing the facsimile transmission/reception function, an operating instruction message when performing the copying function, a message for prompting a user to input a user's evaluation upon looking at a test print, and a message of each function shown as necessary.

At a lower part of the LCD 85, there are disposed dial buttons 86. The dial buttons 86 are input buttons for inputting a telephone or facsimile number for achieving the facsimile function as well as for inputting the number of copies for the copying function. In addition to numeric buttons from "0" to "9", an asterisk button, a sharp button and the like are available.

Further, on the right side of the dial buttons 86, there are disposed a stop button 87*a* to stop the operation, a start button 87*b* to start the operation, a color copy operating button 87*c* to use the multi-function peripheral apparatus 80 as a color copier, a color printer operating button 87*d* to use the apparatus 80 as a color printer, and an answer-phone function button 87*e* to use the apparatus 80 as an answer-phone.

In the center of the operating panel 82, there are disposed a one-touch dial button 87*f* for simplifying the dial operation and a facsimile operating button 87*g* to use the multi-function peripheral apparatus 80 as a facsimile. Accordingly, by using these various buttons 86, 87*a* to 87*g* appropriately, the multi-function peripheral apparatus 80 can be operated.

At the upper surface of the body 81 of the apparatus and at the rear position of the operating panel 82, there is provided the manuscript placement table 83. On this manuscript placement table 83, there are stacked and placed facsimile manuscripts to be transmitted to the other party when using the facsimile function as well as copy manuscripts to be copied when using the copying function. Various manuscripts placed on the manuscript placement table 83 are conveyed from the manuscript placement table 83 to the inside of the body 81 of the apparatus, while manuscript data is read by a scanner 47 (see FIG. 3). Further, at the rear position of the manuscript placement table 83, there is provided a paper feeder 84. Into this paper feeder 84, the paper cassettes (not shown) in which the unprinted print media P of various sizes are stacked and inserted.

A manuscript sensor 88 (see FIG. 3) is placed in the manuscript placement table 83 and detects whether or not there is a manuscript on the manuscript placement table 83. Further, at a position on the near side of the operating panel 82, there is provided a manuscript discharge part 89 which piles up read manuscripts in a stacked condition. At the lower side of this manuscript discharge part 89, there is provided a print medium discharge part 90 which piles up a print media which are printed sheets of paper in a stacked condition. At a lower right side of this print medium discharge part 90, there is provided a video signal input terminal 91. Video signals (image data) outputted from a video camera or the like connected to the video signal input terminal 91 are captured inside the multi-function peripheral apparatus 80 and printed in full color by a printer 61 capable of full color printing.

Figure 2:
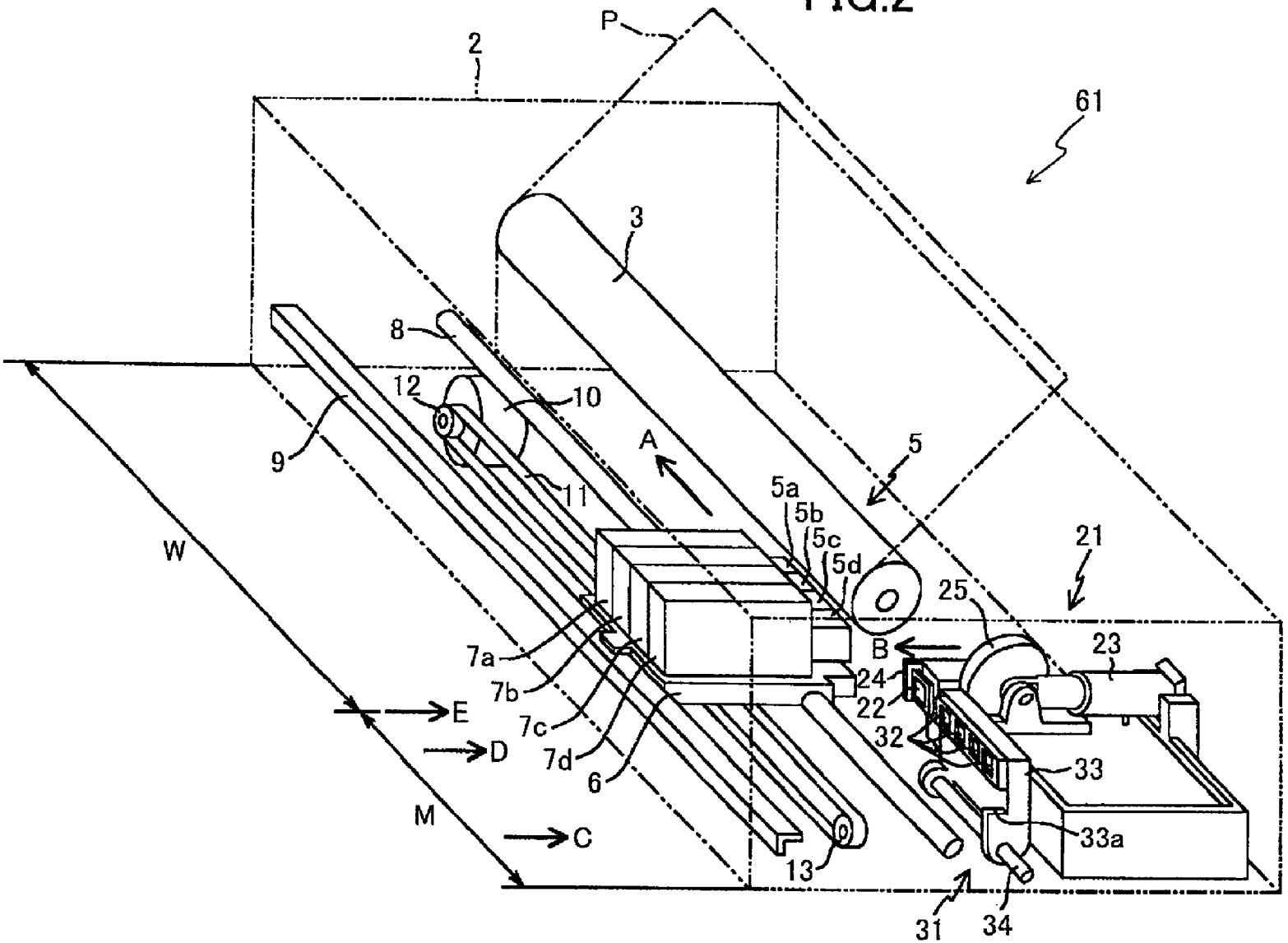
FIG. 2 is a perspective view showing an inkjet printer mounted on the multi-function peripheral apparatus shown in FIG. 1.

FIG. 2 is a perspective view of the printer 61 of the inkjet type to be mounted inside the body 81 of the multi-function peripheral apparatus 80. As shown in FIG. 2, the printer 61 performs printing by moving the print head 5 in the direction of arrow A and the counter-direction of arrow A.

On a frame 2 of the printer 61, a platen roller 3 for conveying the print medium P is rotatably installed, and a guide rod 8 is secured to the frame 2 parallel to this platen roller 3. A carriage 6 is slidably inserted into the guide rod 8, while the carriage 6 is movably supported on the guide rod 8 to be movable in a direction perpendicular to a print medium P conveying direction. The carriage 6 is guided by a guide rail 9 extending in parallel to the guide rod 8.

In the carriage 6, there are mounted ink tanks 7*a* to 7*d* supplying ink to the print head 5 thereof. A plurality of nozzles 5*a* to 5*d* is installed on the print head 5, and an ink ejection port is provided on each of the nozzles 5*a* to 5*d*. The ink tanks 7*a* to 7*d* are respectively filled with 4-color inks of black, yellow, cyan, and magenta sequentially from the left side in FIG. 2. The ink tanks 7*a* to 7*d* respectively supply the inks of different colors sequentially to nozzles 5*a* to 5*d*.

Namely, black ink is ejected from the nozzle 5*a*, yellow ink is ejected from the nozzle 5*b*, cyan ink is ejected from the nozzle 5*c*, and magenta ink is ejected from the nozzle 5*d*. Consequently, the ink is ejected from respective nozzles of the plurality of nozzles 5*a* to 5*d*, and full color printing can be carried out on the print medium P. Further, since each ink tank 7*a* to 7*d* is removably attached, the ink tanks 7*a* to 7*d* are so constructed that any ink tank showing a shortage of the ink can be replaced individually. Therefore, if an ink remainder of any of the ink tanks 7*a* to 7*d* indicates a shortage of the ink, such ink tank can be replaced by opening an open/close lid (not shown).

Further, the carriage 6 can reciprocatingly move in a direction parallel to the platen roller 3 along the guide rod 8, that is, in the direction of arrow A and the counter direction of arrow A, through a belt 11 set up across a drive pulley 12 which is rotated by a carriage motor 10 provided on one side of the frame 2 and a driven pulley 13. As a result, the carriage 6 can print on the print medium P through the print head 5 while reciprocatingly moving in the direction of arrow A and the counter direction of arrow A.

On the right end of the frame 2 on which the carriage 6 can move by means of the carriage motor 10, there is disposed a recovery mechanism 21. The recovery mechanism 21 is for recovering the nozzles 5*a* to 5*d* suffering from ink clogging and adhesion of excess ink residue to a normal operating condition. The recovery mechanism 21 has a suction cap 21 which can individually seal hermetically nozzle ports of the nozzles 5*a* to 5*d* of the print head 5 and a suction pump 23 which can suck in the ink inside the nozzle port of each nozzle 5*a* to 5*d* hermetically sealed by the suction cap 22.

When performing recovery operation by the recovery mechanism 21, the carriage 6 is moved by the carriage motor 10, while the suction cap 22 is advanced by a cam member 25 to be mentioned later in a direction of arrow B and hermetically seals with the suction cap 22 any of the nozzle ports of the nozzles 5*a* to 5*d* whose ejecting condition needs to be recovered. Then, as the suction pump 23 is operated by the cam member 25, air bubbles and dried and solidified ink are sucked in from the nozzle port, thus recovering the ejection condition of the nozzle ports of the nozzles 5*a* to 5*d*. Note that, in this specification, such a series of suction operation is herein called purge processing.

At a position next to the left side of the recovery mechanism 21, there is disposed a wiper member 24. The wiper member 24, being formed like a spatula, is designed to wipe off the nozzle ports of nozzles 5*a* to 5*d* of the print head 5 as the carriage 6 moves. When wiping off the nozzle ports, the wiper member 24 juts out by means of the cam member 25 in the direction of arrow B, while, when not wiping off, retreating by means of the cam member 25 in the counter direction of arrow B. Note that, in this specification, such operation of wiping the excess ink off the nozzle ports of the print head 5 by means of the wiper member 24 is herein referred to as "wiping treatment".

By arranging to wipe the excess ink off the nozzle ports through this wiping treatment, entry of the excess ink into a protective cap 32 to be explained later is stopped, thus further preventing an internal volume of the protective cap 32 from decreasing due to accumulation of ink into the protective cap 32. Consequently, reduction of the internal volume of the protective cap 32 is prevented so that excessive compression of air inside the protective cap 32 generated when the nozzle ports are hermetically sealed by the protective cap 32, namely, generation of positive pressure is prevented. As a result, no ink is being pushed into the nozzle 5*a* due to the positive pressure inside the protective cap 32, and hence, deterioration of an ink ejection status can be prevented.

The cam member 25 is for controlling operations of the recovery mechanism 21 and the wiper member 24, and the cam member 25 is disposed adjacent to the suction pump 23. This cam member 25 is formed capable of linking through a gear mechanism (not shown) to a paper conveying motor (not shown), and the recovery mechanism 21 and the wiper member 24 are operated through rotation of the cam member 25.

Next, a series of operations of the recovery mechanism 21 and the wiper member 24 by means of the cam member 25 will be described. Note that such series of operations is herein referred to as "purge/wiping treatment".

This purge/wiping treatment completes the series of operations as the cam member 25 makes one rotation. First, the purge processing of the purge/wiping treatment is carried out by the recovery mechanism 21. This purge processing first moves the carriage 6 to make the nozzle port subject to the purge processing face the suction cap 22. Next, as the cam member 25 is rotated, the suction cap 22 is jutted out in the direction of arrow B and the nozzle port is hermetically sealed. After the nozzle port is hermetically sealed, sucking operation of ink inside the nozzle port is started by the suction pump 23. As the cam member 25 is further rotated, the sucking operation by the suction pump 23 terminates, then the suction cap 22 retreats in the counter direction of arrow B. The purge processing is thus completed. As a consequence, ink clogging of the nozzle port is eliminated by such purge processing. Thus, the ejection condition of ink is recovered and excellent printing results can be produced.

After the purge processing, as the cam member 25 is further rotated, the wiping treatment is conducted by the wiper member 24. For this wiping treatment, the wiper member 24 is first jutted out in the direction of arrow B to contact the nozzle port which was subjected to the purge processing. Thereafter, the carriage 6 is moved in the direction of arrow A and with the movement of this carriage 6, excess ink deposited on the nozzle port is wiped off. As the cam member 25 further rotates, the wiper member 24 retreats in the counter direction of arrow B. The wiping treatment is thus completed. Through these operations, the series of the purge/wiping treatment is completed. Note that when the purge processing is respectively carried out for all nozzles 5*a* to 5*d*, the cam member 25 makes four turns.

At a position where the nozzles 5*a* to 5*d* moving in the counter direction of arrow A are in the condition of being hermetically sealed by the protective caps 32, that is, at a position (standby position C) where the carriage 6 in an non-printing condition stands by, the cam member 25 is connected to the paper conveying motor through the gear mechanism. In this manner, when the cam member 25 is linked to the paper conveying motor through the gear mechanism, the cam member 25 rotates due to rotation of the paper conveying motor and can control and drive the recovery mechanism 21 and the wiper member 24. Note that when the carriage 6 moves in the direction of arrow A and reaches a preset position (linkage release position E), the cam member 25 is in a non-linkage condition to the paper conveying motor. Further, in the event that the cam member 25 and the paper conveying motor once in the non-linkage condition are to be in linkage again through the gear mechanism, the carriage 6 must be moved again to the standby position C.

Consequently, in a range over which the carriage 6 moves in the direction of arrow A and in the counter direction of arrow A to carry out printing through the print head 5, that is, a range from the vicinity of an end on the left side of the frame 2 in FIG. 2 to the linkage release position E in the vicinity of an end on the right side (a printable range W), the cam member 25 is in the non-linkage condition. On the other hand, unless the carriage 6 crosses the linkage release position E and moves over to the printable range W, that linkage cannot be released, and in a range (a maintenance range M) between the linkage release position E in the vicinity of the end on the right side of the frame 2 in FIG. 2 and the standby position C, the recovery mechanism 21 and the wiper member 24 can be driven.

Note that, when exchanging any of the ink tanks 7*a* to 7*d* mounted on the carriage 6, the carriage 6 is moved to a preset position (an ink tank exchange position D) while the cam member 25 and the paper conveying motor are in the linkage condition. The ink tank exchange position D is on the E side of the link release position inside the maintenance range M and is set such that the nozzle 5*d* of the print head 5 is positioned on the linkage release position E side relative to the position of the wiper member 24 disposed in the direction of arrow A.

In the front position of the cam member 25, there is disposed a protective cap device 31. The protective cap device 31 consists of a plurality of protective caps 32 put on each nozzle 5*a* to 5*d* of the print head 5 as well as a casing 33 which supports these protective caps 32. The protective caps 32 cover each nozzle 5*a* to 5*d* when printing is not conducted by the print head 5, that is, when the carriage 6 is at standby. This prevents ink therein from evaporating and avoids drying of ink at the nozzle ports. The casing 33 is supported slidably and rotatably relative to the guide rod 34 which extends parallel to the moving direction (the direction arrow A) of the carriage 6.

At the front lower part of the casing 33, there is provided an engagement convex part 33*a* engaging the carriage 6 moving in the counter direction of arrow A. Consequently, when the carriage 6 moves in the counter direction of arrow A, the engagement convex part 33*a* engages the carriage 6 so that the protective caps 32 follows the movement of the carriage 6 and slide toward the counter direction of arrow A (the right direction in FIG. 2). Following the slide movement of the casing 33, the casing 33 rotates axially (a counterclockwise direction) relative to the guide rod 34 through a slanted cam mechanism (not shown). As a result, the protective caps 32 rotates in a direction of approaching the print head 5 and hermetically seals the nozzles 5*a* to 5*d* of the print head 5. On the other hand, when the carriage 6 moves in the direction of arrow A, the protective caps 32, while moving in the direction of arrow A, moves away from the print head 5 and returns to an initial condition.

Figure 3:
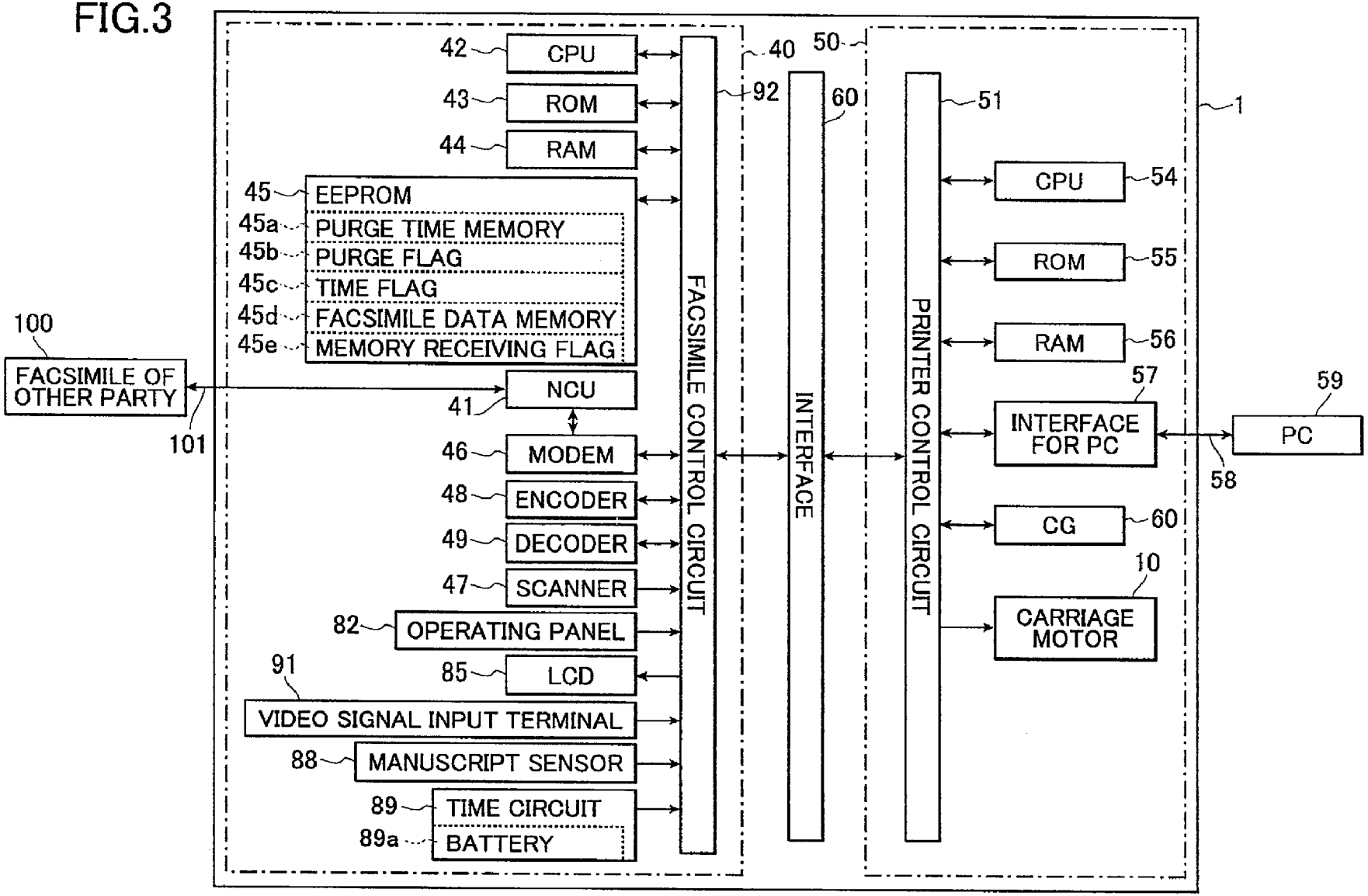
FIG. 3 is a block diagram showing an electrical arrangement of the multi-function peripheral apparatus shown in FIG. 1.

Next, an electrical construction of the multi-function peripheral apparatus 80 will be described. FIG. 3 is a block diagram showing an electrical construction of the multi-function peripheral apparatus 80. The multi-function peripheral apparatus 80 is constituted by a facsimile part 40 and a printer part 50. The facsimile part 40 and the printer part 50 are mutually connected through an interface 60, being capable of transmitting signals and data.

The facsimile part 40 is electrically configured to realize a facsimile function, and has a CPU 42, a ROM 43, a RAM 44, an EEPROM 45, a network control unit (hereinafter referred to as "NCU") 41, a modem 46, an encoder 48, a decoder 49, a scanner 47, an operating panel 82, an LCD 85, a video signal input terminal 91, a manuscript sensor 88, and a measuring circuit 89. These are mutually connected through a facsimile control circuit 92.

The CPU 42, based on various signals which are transmitted and received through the NCU 41, controls each part connected to the facsimile control circuit 92 and executes facsimile operation and the like. The ROM 43 is a non-writable memory in which various programs to be executed by the multi-function peripheral apparatus 80 are stored. The RAM 44 is a memory temporarily storing various data and the like calculated through the CPU 42.

The EEPROM 45 is a writable, nonvolatile memory. Data stored in the EEPROM 45 is held even after power supply to the multi-function peripheral apparatus 80 is turned off. In the EEPROM 45, there are provided a purge time memory 45*a*, a purge flag 45*b*, a time flag 45*c*, a facsimile data memory 45*d*, and a memory receiving flag 46*e*.

In the purge time memory 45*a*, there is stored a purge time to be executed next per color. The purge flag 45*b* memorizes a color to be executed in the purge processing and is provided per color. For example, when the purge flag 45*b* corresponding to black is "ON", the purge processing of black is carried out. The time flag 45*c* memorizes a color, whose purge time has passed, and is provided for each color. For example, when the purge flag 45*c* corresponding to black is "ON", the purge time of black is determined to have passed. When the facsimile memory is in the receiving condition, in the facsimile data memory 45*d*, there is stored facsimile data transmitted through the NCU 41 to be explained later. The memory receiving flag 45*e* memorizes whether or not to memorize data received by the facsimile data memory 45*d*. For example, when the memory receiving flag 45*e* is in the state of "ON", received facsimile data is stored in the facsimile data memory 45*b*.

The NCU 41 is a unit which performs operations such as sending out dial signals to a telephone network and responding to call signals from the telephone network and is connected to the facsimile of other party 100 through the network such as telephone line 101. The modem 46 modulates and demodulates print data and transmits such data, while, at the same time, transmitting and receiving various proceeding signals. The encoder 48 performs encoding of manuscript images read by the scanner 47. The decoder 49 reads facsimile data stored in the RAM 44 and decodes such data. Namely, the facsimile data stored in the RAM 44 is developed by the decoder 49 into bit images. The facsimile data developed into the bit images is again written into the RAM 44. Thereafter, such data is outputted through the interface 60 to the printer part 50 and printed on the print medium P. The scanner 47 is for reading images of the manuscript inserted into the manuscript placement table 83.

The measuring circuit 89 is a circuit for measuring current time including date and has a drive battery 89*a* to continue measuring the current time even after the power supply of the multi-function peripheral apparatus 80 is turned off. The current time of the measuring circuit 28 is read per preset time in the regular purge processing shown in FIG. 4 and collated to the purge time stored in the purge time memory 14*a* of the EEPROM 14. Then, determination is made as to whether or not the purge time has passed.

The printer part 50 has a CPU 54, a ROM 55, a RAM 56, an interface 57 for PC, a character generating circuit (CG) 60, and a carriage motor 10, and these are mutually connected through the printer control circuit 51. Note that copy function is realized through cooperation between the facsimile part 40 and the printer part 50.

The CPU 54 is for controlling the printer part 50 according to a control program stored in the ROM 55. The ROM 55 is a memory incapable of rewriting which stores the control program and the like for performing print processing. The program on the regular purge processing shown in FIG. 4 indicates part of the control program stored in the ROM 55. The RAM 56 is a memory for storing various data.

The interface 57 for personal computer is one of the Centronics data communications devices, being connected to a personal computer (PC) 59 through a communications line 58. Print data outputted from the PC 59 is inputted into the interface 57 for PC byte by byte (or 2 bytes). The CG 60 is a circuit for memorizing a vector font such as characters for printing and converting, by using the font, print data inputted from the personal computer 59 and the like into printable bit image data.

Figure 4:
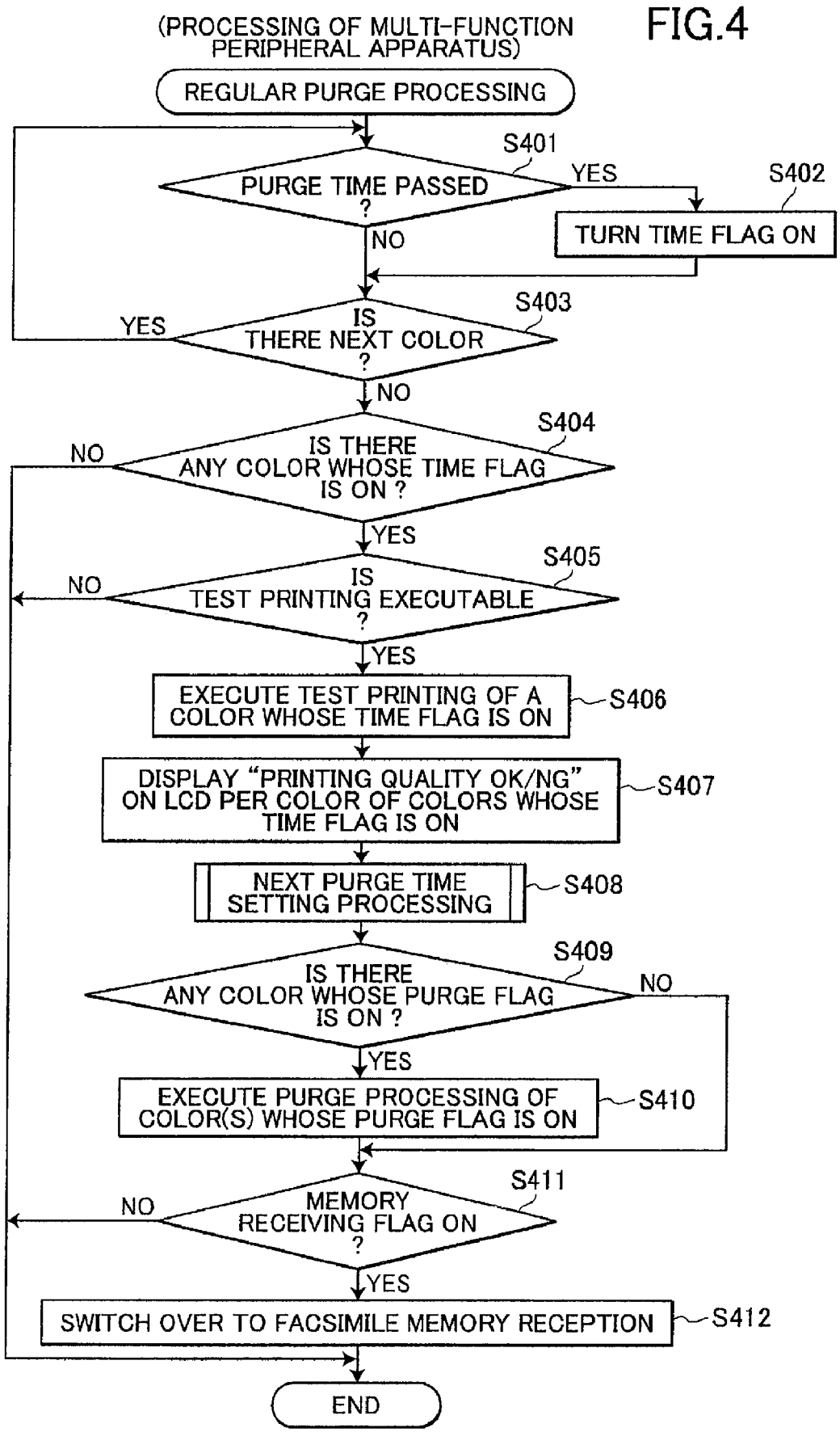
FIG. 4 is a flowchart illustrating a regular purge processing executed by the multi-function peripheral apparatus in accordance with one aspect of the invention.
Figure 5:
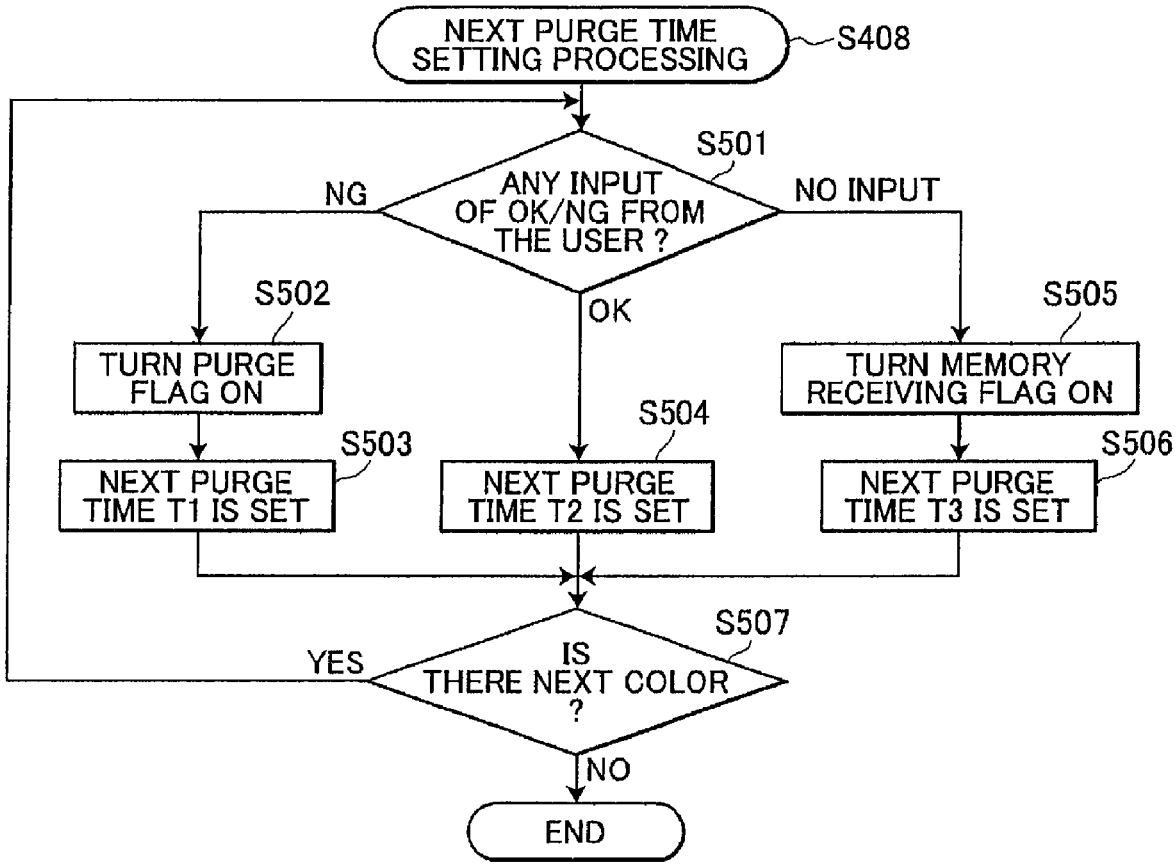
FIG. 5 is a flowchart illustrating a next purge time setting processing executed as a subroutine in the regular purge processing shown in FIG. 4.
Figure 6A:
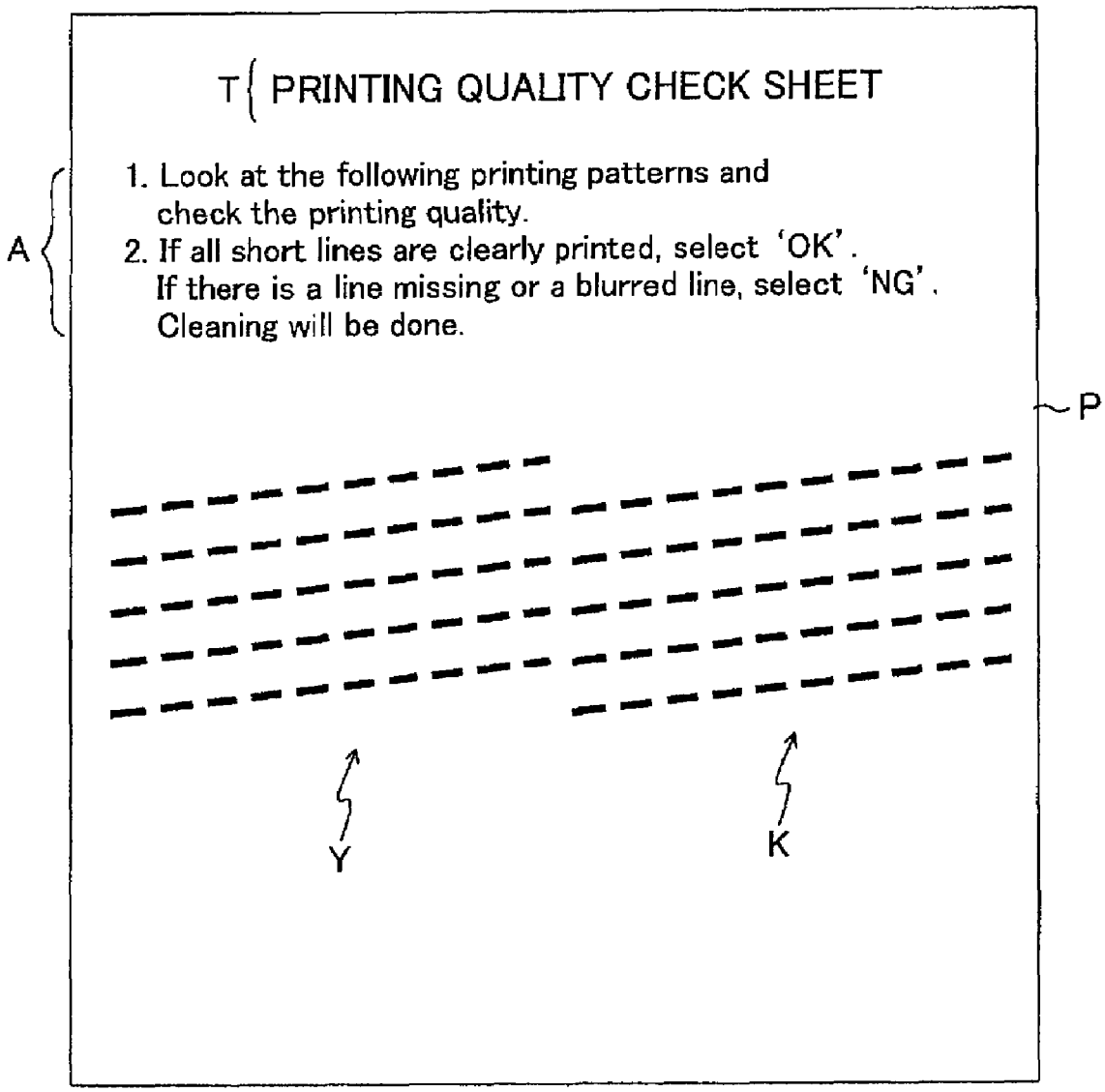
FIG. 6B is an explanatory diagram showing a message box displayed on an LCD during the regular purge processing.
Figure 6B:
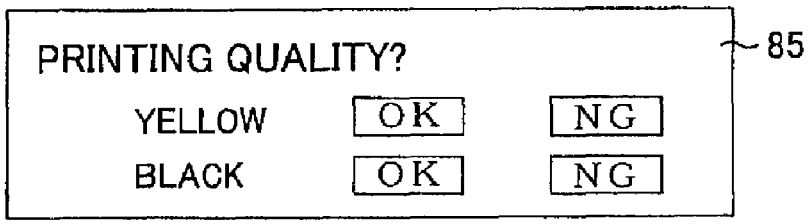

Next, referring to FIGS. 4 to 6, the regular purge processing to be executed by the multi-function peripheral apparatus 80 will be described. FIG. 4 is a flowchart showing the regular purge processing to be executed by the multi-function peripheral apparatus 80, FIG. 5 is a flowchart showing the next purge time setting processing to be executed in S408 of the regular purge processing shown in FIG. 4, FIG. 6A is a diagram showing print medium P test printed in S406 of the regular purge processing shown in FIG. 4, and FIG. 6B is a diagram showing information to be displayed on the LCD 85 in S407 of the regular purge processing.

The regular purge processing shown in FIG. 4 is processing executed in interval interrupt processing which is regularly executed. In this processing, first, determination is made as to whether or not the purge time, among purge time memorized per color in the purge time memory 45*a*, has passed regarding a preset color (S401).

If the purge time has not passed (S401: No), whether or not there is a next color is determined (S403). If the purge time has passed (S401: Yes), after turning the time flag 45*c* regarding the preset color "ON" (S402), determination is made as to whether or not there is a next color (S403).

In S403, if determination is made that there is a next color (S403: Yes), processing from S401 is repeated regarding the next color. If determination is made that there is no next color (S403: No), that is, after determining whether or not the purge time has passed regarding all colors (yellow, magenta, cyan, and black), the time flag 45*c* determines whether or not there is a color in the state of "ON" (S404).

In S404, if the time flag 45*c* has no color in the state of "ON" (S404: No), the processing is finished assuming that there is no color past the purge time. If there is (S404: Yes), determination is made as to whether or not test print to be explained later is in the state of being available (S405). Specifically, determination is made as to whether or not the print medium P is available, whether or not printing other than test printing is being executed, and the like.

In S405, if the test printing is not in the state of being available (S405: No), the processing is finished. If the test printing is in the state of being available (S405: Yes), the time flag 45*c* carries out test printing regarding the color in the state of "ON" (S406), and the time flag 45*c* displays, regarding the color in the state of "ON", "PRINTING QUALITY OK/NG" on the LCD 85 for each color (S407).

Referring to FIG. 6, the test printing of S406 and information displayed on the LCD 85 of S407 will be specifically described. Note that in this embodiment, of the four colors of yellow, magenta, cyan, and black, the time flag 45*c* on yellow and black is in the state of "ON" (the purge time has passed).

When test printing is made through processing of S406, the print medium P bearing information shown in FIG. 6A is discharged from a manuscript discharge part 89. Specifically, the print medium P carries Title T, "Printing Quality Check Sheet," on the top. Below the Title T, comments A appear for the user which read as follows. "1. Look at the following printing patterns and check the printing quality. 2. If all short lines are clearly printed, select 'OK'. If there is a line missing or a blurred line, select 'NG'. Cleaning will be done." On the left side below, as a printing pattern Y, there is printed a group of short lines in yellow, and on the right side, there is printed a group of short lines in black as a printing pattern K.

Further, through the processing of S407, as shown in FIG. 6B, on the LCD 85, there are displayed "OK" and "NG" corresponding to yellow indicating the state of "ON" for the time flag 45*c* and "OK" and "NG" corresponding to black indicating the state of "ON" for the time flag.

In this manner, through the processing of S406, the print medium P shown in FIG. 6A is discharged from the manuscript discharge part 89. When information shown in FIG. 6B is displayed through the processing of S407 on LCD 85, the user looks at the state of printing patterns Y and K of the print medium P shown in FIG. 6A. If satisfied with the state of printing pattern Y, the user touches the "OK" portion displayed corresponding to yellow, and if not satisfied with the state of printing pattern K, the user touches the "NG" portion displayed corresponding to black. The user's evaluation of the printing quality as OK or NG per color is thus inputted through the LCD 85.

Again, back to the flowchart shown in FIG. 4, the description will continue. Upon completion of the processing of S406 and S407, the processing of the next purge time setting is executed (S408). The processing of the next purge time setting will be described with reference to FIG. 5. This processing is to reset a color for which the time flag 45*c* is in the state of "ON", that is, the set purge time. In this processing, first, determination is made as to whether or not the user has inputted "OK" or "NG" (S501) for the preset color.

In S501, if "NG" is inputted (S501: NG), the purge flag 45*b* for the preset color is set at the state of "ON" (S502). Then, a next purge time T1 for the color is set at a purge time memory T2 (S503) and determination is made as to whether or not there is a next color (S507).

Further, in S501, if "OK" is inputted (S501: OK), a next purge time T2 for the preset color is set at a purge time memory 45*a* without setting the purge flag 45*b* for the preset color at the state of "ON" (S504) and determination is made as to whether or not there is a next color (S507).

Still further, in S501, if there is no input from the user (S501: no input), the memory receiving flag 45*d* is set at the state of "ON" (S505). Then, a next purge time T3 for the preset color is set (S506) and determination is made as to whether or not there is a next color (S507).

In the processing of S507, if there is a next color (S507: Yes), processing from S501 regarding the next color is repeated. If there is no next color (S507: No), that is, after setting the next purge times T1, T2 and T3 for all the colors that the time flag 45*c* is in "ON" state (S507: No), this processing is finished.

Of the next purge times T1, T2, and T3, the next purge time T1 is set so that an interval from the preceding purge time becomes the longest and the next purge times T2 and T3 are set so that intervals from the preceding purge time become shorter in the order of the next purge time T2 and the next purge time T3. For example, there will be following settings: an interval of 20 days from the purge time preceding the next purge time T1, an interval of 3 days from the purge time preceding the next purge time T2, and an interval of 1 day from the purge time preceding the next purge time T3.

Again, referring to FIG. 4, the processing of S408 is finished, and upon setting the next purge times T1, T2, and T3 regarding all colors for which the time flag 45*c* is in the state of "ON", determination is made as to whether or not there is a color that the purge flag 45*c* is "ON" (S409).

If there is such a color (S409: Yes), the purge processing is carried out (S410) only for a color for which the purge flag 45*b* is in the state of "ON".

Namely, the purge processing is carried out in S410 when "NG" is inputted in S501 (S501: NG). It is such a case where the user has evaluated the printing quality by looking at the print medium P (printing quality check sheet) shown in FIG. 6A and touched from the LCD 85 an "NG" portion for a color. Then, only for that color, the purge processing is carried out. Accordingly, when the user determines that the printing quality is not satisfactory, the purge processing is carried out and the printing quality can be recovered.

On the other hand, in S501, when "OK" is inputted (S501: OK), in other words, the user who evaluated the printing quality by looking at the print medium P (printing quality check sheet) shown in FIG. 6A and touched from the LCD 85 an "OK" portion for a color, then, for that color, the purge processing is not carried out. For that color, in the processing of S504, by setting the next purge time T2 at the purge time memory 45*a*, the next time purge processing is extended. Hence, redundant purge processing is not carried out forcibly or automatically insofar as the printing quality required by the user is met, so that wasteful consumption of ink can be prevented.

Further, an interval from the purge time preceding the next purge time T2 to be set in S504 is set at a shorter interval than the interval preceding the next purge time T1 to be set in S503. Hence, as for the color for which no purge processing was carried out (the color for which the purge processing was extended), the next purge time arrives sooner than the color for which the purge processing was carried out. This means that by obtaining the user's determination of execution and non-execution of the recovery operation in an earlier stage, a period of time during which printing is carried out while the printing quality is in the deteriorating state can be generally shortened.

On the other hand, in the processing of S409, if there is no color for which the purge flag 45*c* is in the state of "ON" (S409: No), the processing of S410 is skipped and determination is made as to whether or not the memory receiving flag 45*e* is "ON" (S411). As a result, if the memory receiving flag 45*d* is in the state of "ON" (S411: Yes), a switchover to the facsimile memory reception is made (S412) and this processing terminates. If the memory receiving flag 45*d* is not in the state of "ON" (S411: No), this processing terminates.

Namely, the switchover to the facsimile memory reception is made in S412 when there is "No Input" (S501: NG) in S501, in other words, when neither the "NG" portion nor the "OK" portion displayed on the LCD 85 is touched by the user. Even in this case, the processing of S410 is skipped, so that no purge processing is executed, and in the processing of S506, the next purge time T3 is set at the purge time memory 45*a* and the next purge processing is extended. Therefore, redundant execution of the recovery operation is not forcibly or automatically carried out and so wasteful consumption of ink can be prevented.

Further, the interval from the purge time preceding the next purge time T3 to be set in S506 is set shorter than the interval from the purge time preceding the next purge time T1 to be set in S503. Hence, as for the color for which no purge processing was carried out (the color for which the purge processing was extended), the next purge time arrives sooner than the color for which the purge processing was carried out. This means that by obtaining the user's determination of execution and non-execution of the recovery operation in an earlier stage, a period of time during which printing is carried out while the printing quality is in the state of deterioration can be generally shortened.

Still further, the interval from the purge time preceding the next purge time T3 to be set in S506 is set shorter than the interval from the purge time preceding the next purge time T2 to be set in S504. Hence, a request can be made to receive the user's evaluation as to whether or not the printing quality is acceptable in the earlier stage.

Furthermore, when the "NG" portion and the "OK" portion displayed on the LCD 85 are not touched by the user, in the processing of S412, a switchover to the facsimile memory reception is automatically made. This can prevent a following adverse effect from occurring. As a result of printing onto the print medium P facsimile data received while the printing quality is in the deteriorating state, the facsimile data cannot be read from the print medium and the facsimile data is erased so that the facsimile data cannot be printed again on the print medium.

Next, referring to FIG. 7 and FIG. 8, the regular purge processing in a second embodiment will be described. In the regular purge processing of the first embodiment, description was made of a case of managing the purge time per color of yellow, magenta, cyan, and black. In the second embodiment, yellow, magenta, cyan, and black are managed by a single purge time. Note that to realize the regular purge processing in the second embodiment through the multi-function peripheral apparatus 80, as explained in FIG. 2, there is no need of installing suction caps 22 that can individually seal nozzle ports of the nozzles 5*a* to 5*d* of the print head 5 hermetically. The protective caps 32 can be provided with a function of covering the nozzles 5*a* to 5*d* of the print head 5 at the time of the purge processing.

Figure 7:
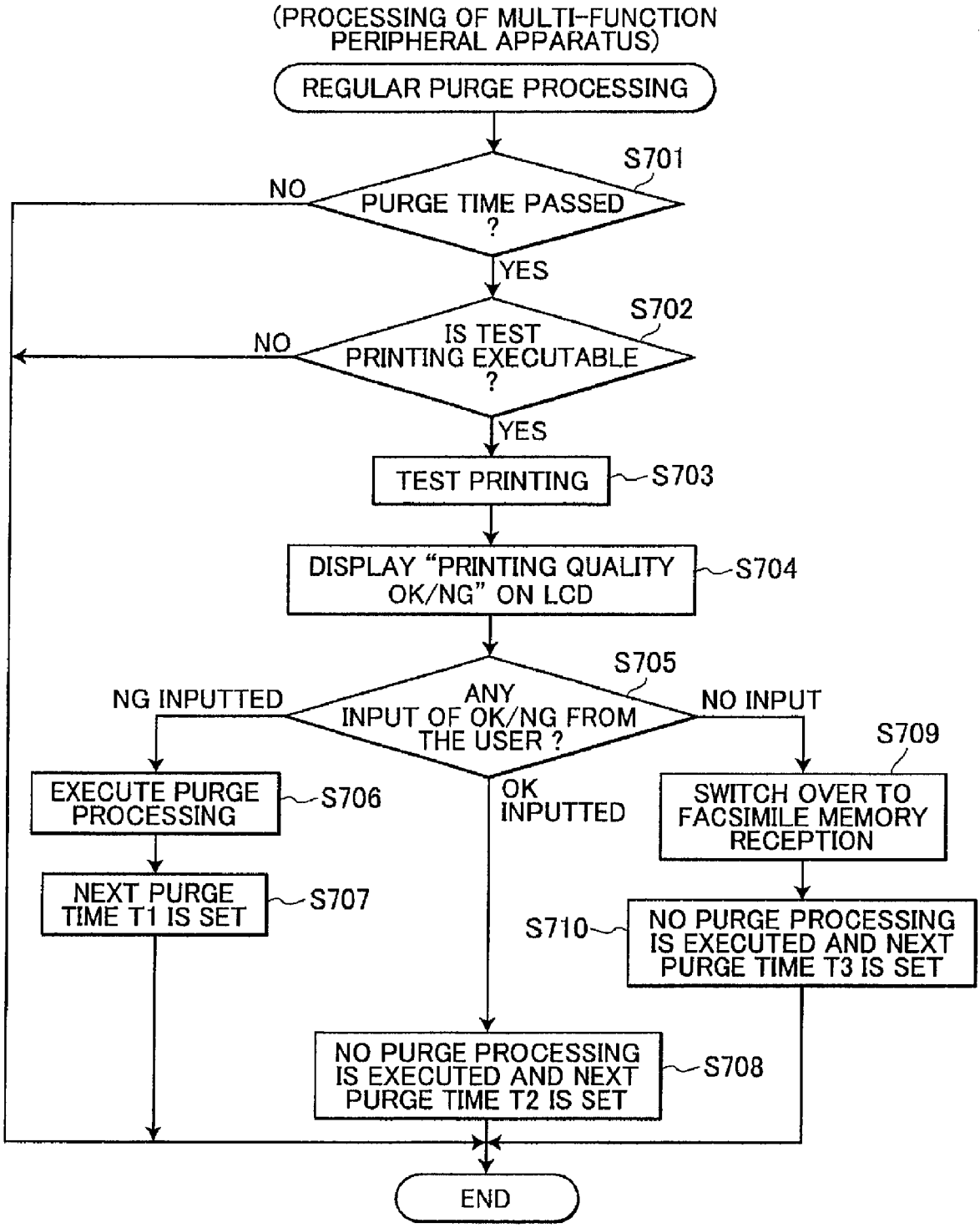
FIG. 7 is a flowchart illustrating a regular purge processing executed by the multi-function peripheral apparatus in accordance with another aspect of the invention.
Figure 8A:
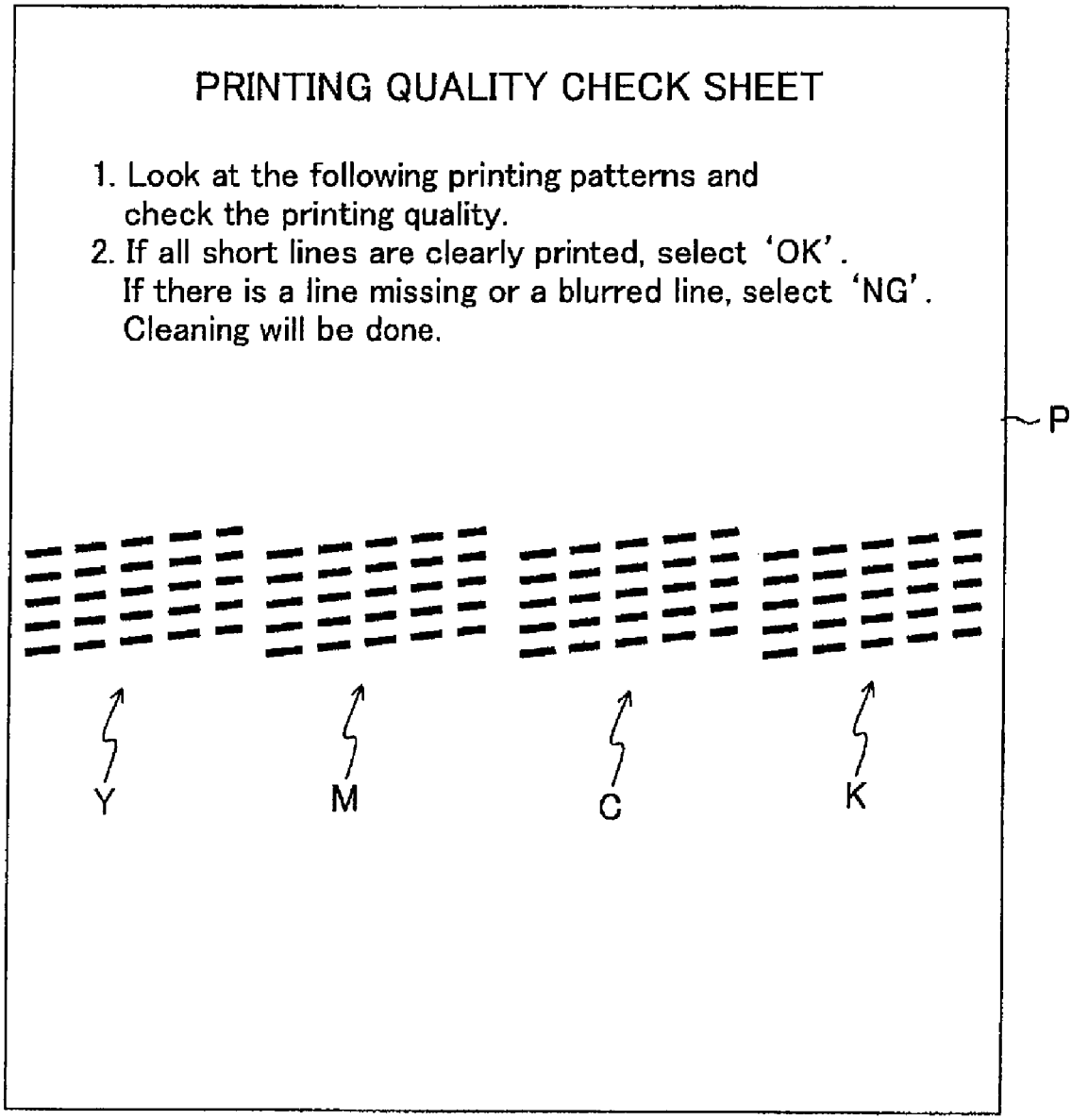
FIG. 8A is an explanatory diagram showing a printing quality check sheet printed during the regular purge processing illustrated in FIG. 7.
Figure 8B:
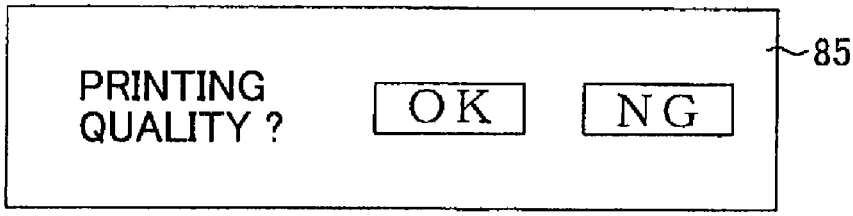
FIG. 8B is an explanatory diagram showing a message box displayed on an LCD during the regular purge processing illustrated in FIG. 7.

FIG. 7 is a flowchart showing the regular purge processing in accordance with another aspect of the invention, FIG. 8A is a diagram showing the print medium P subjected to test printing in S703 of the purge processing, and FIG. 8B is a diagram showing information to be displayed on the LCD 85 in S704 of the purge processing.

The regular purge processing in accordance with another aspect is a processing executed in interval interrupt processing regularly carried out. In this processing, first, determination is made as to whether or not the purge time memorized in the purge time memory 45*a* has passed (S701). If the purge time has passed (S701: Yes), determination is made as to whether or not the status is such that test printing can be made (S702). If the status is such that test printing can be made (S702: Yes), test printing is made (S703) and "Printing Quality OK/NG" is displayed on the LCD 85 (S704).

Referring to FIG. 8, the test printing of S703 and the display of S704 will be specifically described. Upon test printing through the processing of S703, the print medium P bearing information shown in FIG. 5A is discharged from the manuscript discharge part 89. Specifically, the following information is on the print medium P sequentially from the top: "Printing Quality Check Sheet" and therebelow as a comment to the user, "1. Look at the following printing patterns and check the printing quality. 2. If all short lines are clearly printed, select 'OK'. If there is a line missing or a blurred line, select 'NG'. Cleaning will be done." From the left side therebelow, there are sequentially printed a group of short lines displayed in yellow as the printing pattern Y, a group of short lines displayed in magenta as the printing pattern M, a group of short lines shown in cyan as the printing pattern C, and a group of short lines displayed in black as the printing pattern K. On the other hand, through the processing of S704, on the LCD 85, there are displayed "OK" and "NG" as illustrated in FIG. 8B.

In this manner, through the processing of S703, the print medium P shown in FIG. 5A is discharged from the manuscript discharge table 89, and through the processing of S704, information shown in FIG. 8B is displayed on the LCD 85. Then, the user looks at the status of the printing patterns Y, M, C, and K of the print medium P shown in FIG. 8A. If the printing quality is satisfactory, the user touches the "OK" portion, and if not satisfactory, the user touches the "NG" portion. In this manner, the user's evaluation of the printing quality regarding each color is inputted through the LCD 85.

Again, referring to FIG. 7, upon completion of the processing of S703 and S704, determination is made as to whether or not there was an input of OK/NG from the user (S705). As a result, if "NG" has been inputted (S705: NG), the purge processing is executed (S706), the next purge time T1 is set (S707), and this processing terminates. Further, in S705, if "OK" has been inputted (S705: OK), the purge processing is not executed, the next purge time T2 is set (S708), and this processing terminates. Furthermore, in S705, if there is no inputting from the user (S705: No Input), the switchover is made to the facsimile memory reception (S709), the purge processing is not executed, the next purge time T3 is set (S710), and this processing terminates. Note that the next purge times T1, T2, and T3 are set in the same way as the regular purge processing of the first embodiment.

According to the regular purge processing as described above, the same effect as the regular purge processing of the firstly described aspect can be delivered. Further, in the regular purge processing of the firstly described aspect, the purge time is managed per color, so that in keeping with usage frequency of each color, execution and non-execution of the purge operation can be managed, thus further preventing the ink from being wastefully consumed. On the other hand, in the regular purge processing of the secondly described aspect, since the respective colors are managed by one purge time, processing burden in the regular purge processing can be reduced. Further, the structure of the apparatus can be simplified.

For example, description has been made when the regular purge processing is managed per color in the firstly descried aspect of the invention, while respective colors are collectively managed in the secondly described aspect. However, methods of managing color in the regular purge are by no means limited to these cases. Another configuration may be adopted, in which cyan, magenta, and yellow are managed by one purge time, while black marked by a generally higher usage frequency is managed by a purge time different from cyan, magenta, and yellow.

Moreover, according the first and the second aspects of the invention, description has been made with respect to a case where the next purge time is set on the purge time memory 45*a*. However, there may be provided a counter for counting time until the next purge time is executed and the counter may be so configured as to control an interval of execution of the purge processing.

What is claimed is:

1. An image-forming apparatus comprising:

a print head having an ink ejection port from which ink is ejected;

a recovery mechanism that executes recovery operations for recovering an ejection condition of ink ejected from the ink ejection port of the print head;

a time measuring unit that measures a preset period of time from a time when a recovery operation is executed by the recovery mechanism until a scheduled time when a subsequent recovery operation is to be executed;

a testing unit that instructs the print head to print a predetermined test image on a print medium after expiration of the preset period of time and before execution of the subsequent recovery operation;

an input unit that is configured to accept a user's evaluation with respect to the predetermined test image printed by the print head; and a control unit that instructs the recovery mechanism to postpone execution of the subsequent recovery operation when the user's evaluation indicates that the predetermined test image printed by the print head is satisfactory, wherein the control unit further instructs the recovery mechanism to postpone execution of the subsequent recovery operation when the input unit fails to receive the user's evaluation with respect to the predetermined test image printed by the print head.

2. The image-forming apparatus according to claim 1, wherein the control unit instructs the recovery mechanism to execute the subsequent recovery operation when the user's evaluation indicates that the predetermined test image printed by the print head is unsatisfactory.

3. The image-forming apparatus according to claim 1, wherein an extended period of time in which to postpone execution of the subsequent recovery operation when the input unit fails to receive the user's evaluation is shorter than an extended period of time in which to postpone execution of the subsequent recovery operation when the user's evaluation indicates that the predetermined test image printed by the print head is satisfactory.

4. The image-forming apparatus according to claim 1, further comprising:

a data receiving portion that is configured to receive printable data from an external device; and a memory for storing the printable data, wherein the control unit further instructs the print head to print the printable data when the user's evaluation indicates that the predetermined test image printed by the print head is satisfactory.

5. The image-forming apparatus according to claim 1, further comprising:

a first setting unit that sets a first period of time as the preset period of time to be measured by the time measuring unit when a recovery operation is executed by the recovery mechanism;

a second setting unit that sets a second period of time as the preset period of time when execution of a recovery operation is postponed after expiration of the first period of time set by the first setting unit, wherein the second period of time is shorter than the first period of time; and a third setting unit that sets a third period of time as the preset period of time when execution of a recover operation is postponed after expiration of the first period of time set by the first setting unit due to failure to receive the user's evaluation in the input unit, wherein the third period of time is shorter than the second period of time.

6. The image-forming apparatus according to claim 5, wherein all of the first period of time, the second period of time, and the third period of time are set on a day basis.

7. The image-forming apparatus according to claim 1, further comprising a display unit that displays a message box requesting the user to input the user's evaluation with respect to the predetermined test image printed by the print head.

8. The image-forming apparatus according to claim 1, wherein the print head has a plurality of ink ejection ports from which ink of more than two colors are distinctly ejected.

9. The image-forming apparatus according to claim 8, wherein the recovery mechanism executes the recovery operations on an ink color basis.

10. The image-forming apparatus according to claim 8, wherein the recovery mechanism executes the recovery operation with respect to the plurality of ink ejection ports formed in the print head.

11. An image-forming apparatus comprising:

a print head having an ink ejection port from which ink is ejected;

a recovery mechanism that executes recovery operations for recovering an ejection condition of ink ejected from the ink ejection port of the print head;

a time measuring unit that measures a preset period of time from a time when a recovery operation is executed by the recovery mechanism until a scheduled time when a subsequent recovery operation is to be executed;

a testing unit that instructs the print head to print a predetermined test image on a print medium after expiration of the preset period of time and before execution of the subsequent recovery operation;

an input unit that is configured to accept a user's evaluation with respect to the predetermined test image printed by the print head;

a control unit that instructs the recovery mechanism to postpone execution of the subsequent recovery operation when the user's evaluation indicates that the predetermined test image printed by the print head is satisfactory;

a data receiving portion that is configured to receive printable data from an external device; and a memory for storing the printable data, wherein the control unit further instructs the print head to print the printable data when the user's evaluation indicates that the predetermined test image printed by the print head is satisfactory, wherein the control unit controls the memory to store the printable data therein without printing the printable data with the print head when the input unit fails to receive the user's evaluation with respect to the predetermined test image printed by the print head.

12. An image-forming apparatus comprising:

a print head having an ink ejection port from which ink is ejected;

a recovery mechanism that executes recovery operations for recovering an ejection condition of ink ejected from the ink ejection port of the print head;

a time measuring unit that measures a preset period of time from a time when a recovery operation is executed by the recovery mechanism until a scheduled time when a subsequent recovery operation is to be executed;

a testing unit that instructs the print head to print a predetermined test image on a print medium after expiration of the preset period of time and before execution of the subsequent recovery operation;

an input unit that is configured to accept a user's evaluation with respect to the predetermined test image printed by the print head;

a control unit that instructs the recovery mechanism to postpone execution of the subsequent recovery operation when the user's evaluation indicates that the predetermined test image printed by the print head is satisfactory;

a first setting unit that sets a first period of time as the preset period of time to be measured by the time measuring unit when a recovery operation is executed by the recovery mechanism; and a second setting unit that sets a second period of time as the preset period of time when execution of a recovery operation is postponed after expiration of the first period of time set by the first setting unit, wherein the second period of time is shorter than the first period of time.

13. The image-forming apparatus according to claim 12, wherein both the first period of time and the second period of time are set on a day basis.

14. An image-forming apparatus comprising:

a print head having an ink ejection port from which ink is ejected;

a recovery mechanism that executes recovery operations for recovering an ejection condition of ink ejected from the ink ejection port of the print head;

a time measuring unit that measures a preset period of time from a time when a recovery operation is executed by the recovery mechanism until a scheduled time when a subsequent recovery operation is to be executed;

a testing unit that instructs the print head to print a predetermined test image on a print medium after expiration of the preset period of time and before execution of the subsequent recovery operation;

an input unit that is configured to accept a user's evaluation with respect to the predetermined test image printed by the print head; and a control unit that is configured to determine, based on the user's evaluation inputted to the input unit, whether or not the subsequent recovery operation is to be executed immediately after expiration of the preset period of time, wherein the control unit is further configured to determine non-execution of the subsequent recovery operation immediately after expiration of the preset period of time when the input unit fails to receive the user's evaluation with respect to the predetermined test image printed by the print head.

15. The image-forming apparatus according to claim 14, wherein the control unit is further configured to determine a timing when the subsequent recovery operation is to be executed when the input unit fails to receive the user's evaluation with respect to the predetermined test image printed by the print head.

16. An image-forming apparatus comprising:

a print head having an ink ejection port from which ink is ejected;

a recovery mechanism that executes recovery operations for recovering an ejection condition of ink ejected from the ink ejection port of the print heat;

a time measuring unit that measures a preset period of time from a time when a recovery operation is executed by the recovery mechanism until a scheduled time when a subsequent recovery operation is to be executed;

a testing unit that instructs the print head to print a predetermined test image on a print medium after expiration of the preset period of time and before execution of the subsequent recovery operation;

an input unit that is configured to accept a user's evaluation with respect to the predetermined test image printed by the print heat; and a control unit that is configured to determine, based on the user's evaluation inputted to the input unit, whether or not the subsequent recovery operation is to be executed immediately after expiration of the preset period of time, wherein the control unit is further configured to determine a timing when the subsequent recovery operation is to be executed when the control unit determines non-execution of the subsequent recovery operation immediately after expiration of the preset period of time.

* * * * *